US008096258B2

(12) United States Patent
Bierma

(10) Patent No.: US 8,096,258 B2
(45) Date of Patent: Jan. 17, 2012

(54) COLLAPSIBLE CATAMARAN

(76) Inventor: Jochum Bierma, Österreich (AT)

( * ) Notice: Subject to any disclaimer, the term of this patent is extended or adjusted under 35 U.S.C. 154(b) by 292 days.

(21) Appl. No.: 12/383,965

(22) Filed: Mar. 31, 2009

(65) Prior Publication Data

US 2009/0260555 A1 Oct. 22, 2009

(30) Foreign Application Priority Data

Apr. 17, 2008 (AT) ..... A 609/2008

(51) Int. Cl.
*B63B 7/00* (2006.01)

(52) U.S. Cl. ..... 114/354

(58) Field of Classification Search ..... 114/343, 114/345, 354, 355, 364, 61.1, 61.14, 61.15, 114/61.22, 61.25, 61.27, 61.32
See application file for complete search history.

(56) References Cited

U.S. PATENT DOCUMENTS

| | | | | |
|---|---|---|---|---|
| 1,715,312 | A * | 5/1929 | Steele | 114/61.25 |
| 3,986,219 | A * | 10/1976 | Michowski | 114/354 |
| 4,223,620 | A | 9/1980 | Dudouyt | |

FOREIGN PATENT DOCUMENTS

| | | |
|---|---|---|
| DE | 84 28 699 | 5/1986 |
| EP | 0 650 885 | 5/1995 |
| FR | 2 749 269 | 12/1997 |

* cited by examiner

*Primary Examiner* — Daniel Venne
(74) *Attorney, Agent, or Firm* — Collard & Roe, P.C.

(57) ABSTRACT

A collapsible catamaran is described, comprising two hulls (1) and a frame (4) which connects the two hulls (1) in a detachable manner and carries plug-in noses (3) which engage in plug-in receptacles (2) of the hulls (1). In order to provide advantageous plug-in connections it is proposed that the plug-in noses (3) each comprise a guide tube (17) with at least one rubber-elastic clamping ring (18) which encloses the guide tube (17) on the outside, rests on an axial abutment (23) and can be subjected to axial pressure with the help of an actuator (22) penetrating the guide tube (17).

5 Claims, 5 Drawing Sheets

COLLAPSIBLE CATAMARAN

CROSS REFERENCE TO RELATED APPLICATIONS

Applicant claims priority under 35 U.S.C. §119 of Austrian Application No. A 609/2008 filed on Apr. 17, 2008.

FIELD OF THE INVENTION

The invention relates to a collapsible catamaran with two hulls and a frame which connects the two hulls in a detachable manner and carries plug-in noses which engage in plug-in receptacles of the hull.

DESCRIPTION OF THE PRIOR ART

It is known in the assembly of a catamaran (FR 2 749 269 A1) to connect the two hulls by a frame in a detachable manner, so that after the loosening of the connection the two hulls and the frame which is optionally additionally collapsible form separate components. The power transmission between the frame and the hulls cause difficulties in such collapsible catamarans. In order to counteract such difficulties it is known (U.S. Pat. No. 4,223,620 A) to embed a U-shaped support tube in each of the hulls, with the web of said support tube which links the two legs extending in the longitudinal direction and with the legs protruding upwardly from the hull forming plug-in receptacles for plug-in noses provided on the frame. It remains open however how the plug-in connection between the hulls and the frame connecting the hulls can be made in a play-free manner without using any tools.

SUMMARY OF THE INVENTION

The invention is based on the object of providing a collapsible catamaran of the kind mentioned above in such a way that the frame can be connected with the hulls without tools in a play-free manner via plug-in connections which allow advantageous power transmission between the hulls and the frame.

This object is achieved by the invention in such a way that the plug-in noses each comprise a guide tube with at least one rubber-elastic clamping ring which encloses the guide tube on the outside, is supported on an axial abutment and can be subjected to axial pressure with the help of an actuator penetrating the guide tube.

By providing at least one rubber-elastic clamping ring which is supported on an abutment and can be pressed with the help of an actuator in the axial direction against the abutment, a simple play-free clamping of the respective plug-in nose of the frame in the associated plug-in receptacle of the hulls is achieved because as a result of a substantially constancy in volume of the rubber-elastic clamping ring its axial compressing consequently leads to an increase in its outside circumference and thus to a clamping of the guide tube in the plug-in receptacle, which guide tube supports the clamping ring.

Especially advantageous constructional conditions are obtained in this connection when the guide tube of the plug-in noses comprises two clamping rings—which are held at an axial distance from each other by a support sleeve which is held in a displaceable manner on the guide tube, of which one clamping ring is supported on the abutment and the other is pressurized by the actuator. In this case, the guide tubes are fixed via two clamping points disposed at an axial distance from each other within the plug-in receptacles, which excludes tilting of the plug-in noses within the plug-in receptacles within the scope of the necessary movement play for inserting the plug-in noses in the plug-in receptacles. Due to attack on merely one of the two clamping rings, no change of the actuator is required for pressurizing the clamping rings.

Although different actuator constructions can be used (since it is merely necessary to ensure the axial pressurization of a clamping ring), advantageous embodiments are obtained when the actuators comprise an axially adjustable pressurization head protruding from the insertion end of the respective guide tube, on which rests a pressure ring enclosing the insertion end of the guide tube for pressurization of the clamping ring resting against the same. For axial displacement, a drawbar which penetrates the respective guide tube and is linked to an eccentric drive can act upon the pressurization head. It is also possible to allow a spindle drive penetrating the respective guide tube to act upon the pressurization head. In both cases, the pressurization heads which can be guided in a simple manner in the respective guide tubes in an axially displaceable manner can be axially displaced for pressurizing the clamping rings against the guide tubes, so that the pressure rings resting on the pressurization heads are able to transmit respective compressive forces on the face sides of the clamping rings resting against the same.

BRIEF DESCRIPTION OF THE DRAWINGS

The subject matter of the invention is shown in the drawing by way of example, wherein.

DESCRIPTION OF THE PREFERRED EMBODIMENT

Figure 2:
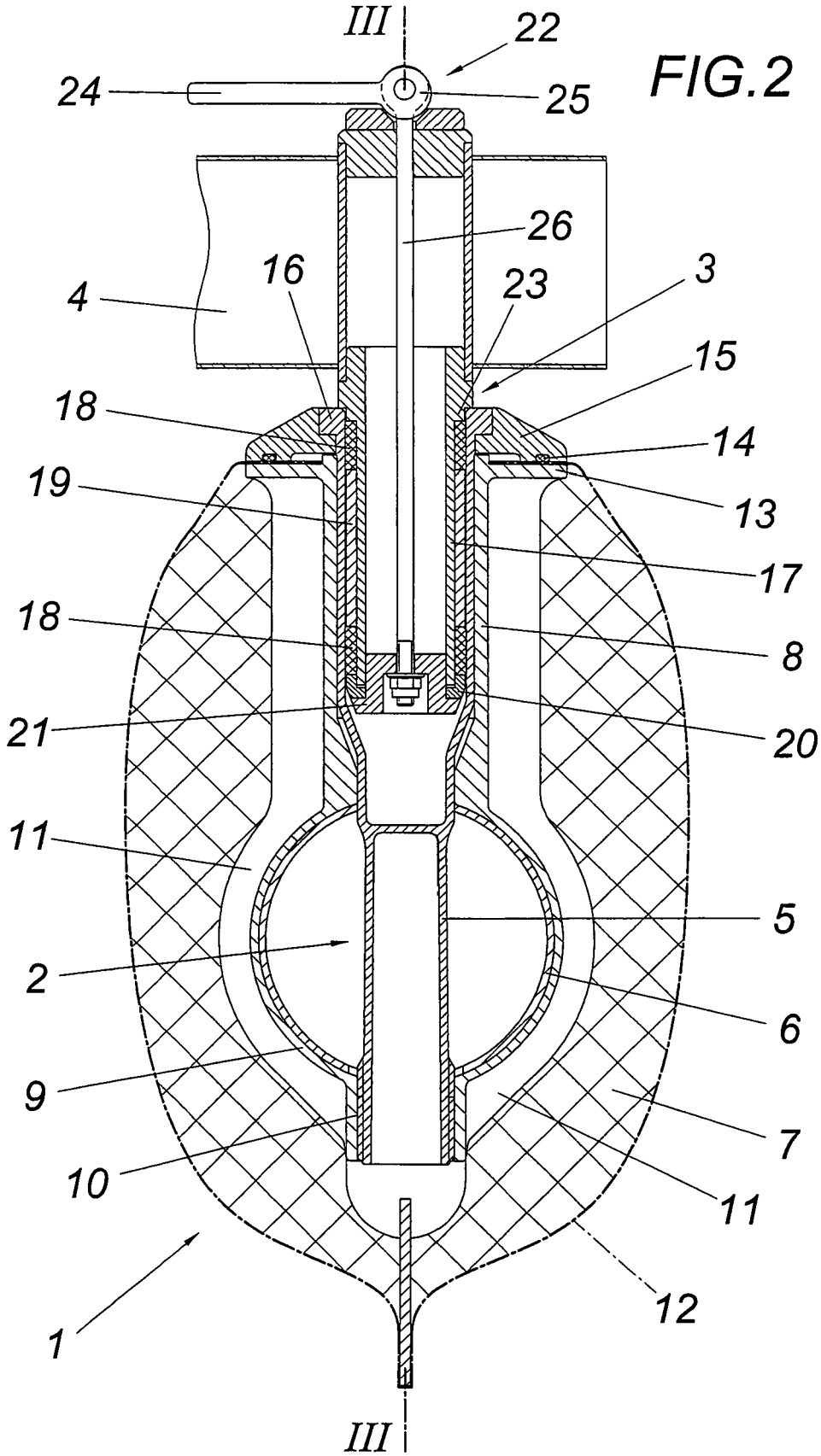
FIG. 2 shows the hull of a catamaran in the area of a plug-in connection with the frame in a cross-sectional view on a reduced scale.
Figure 3:
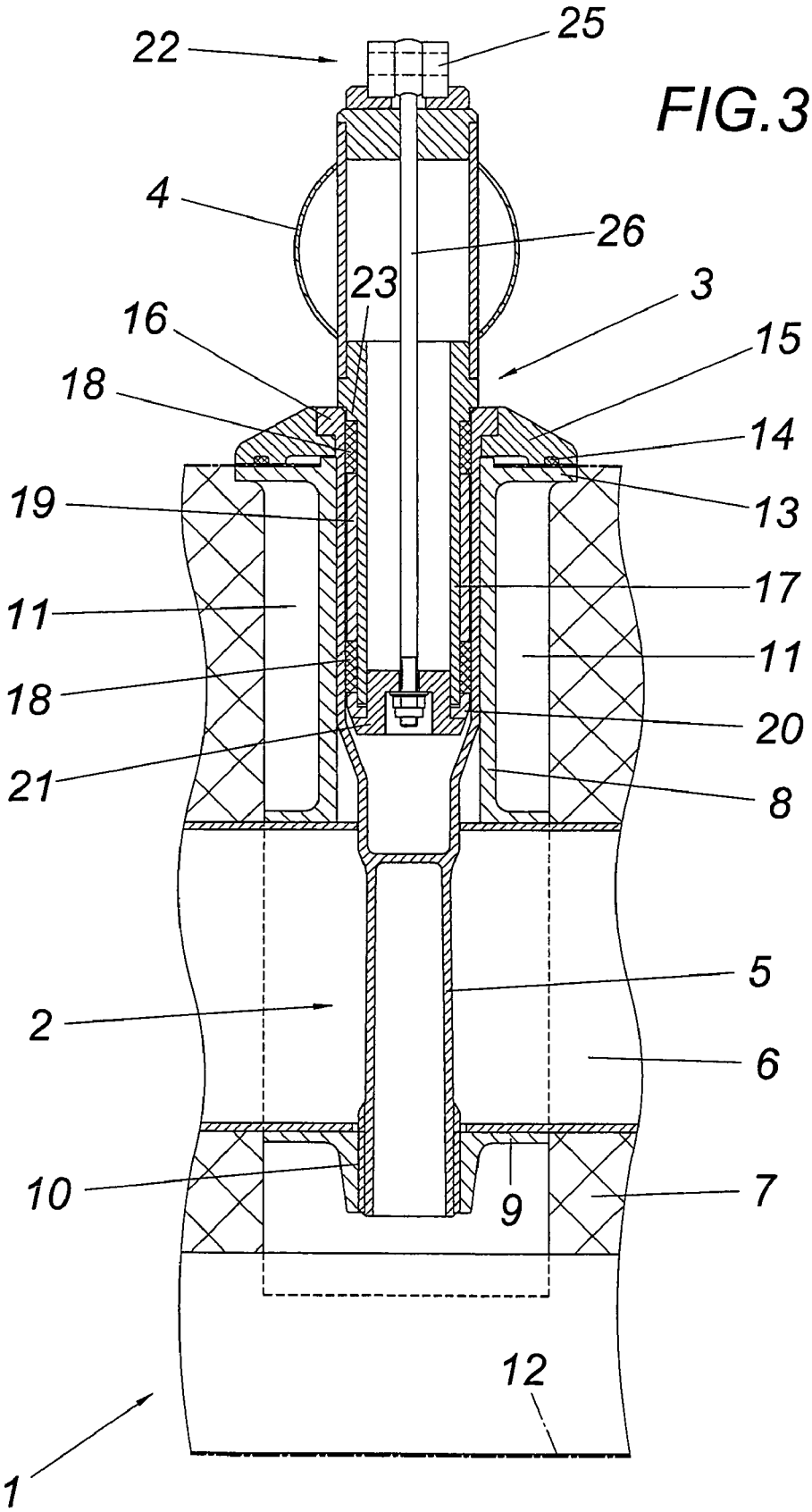
FIG. 3 shows a sectional view along the line III-III in FIG. 2.
Figure 5:
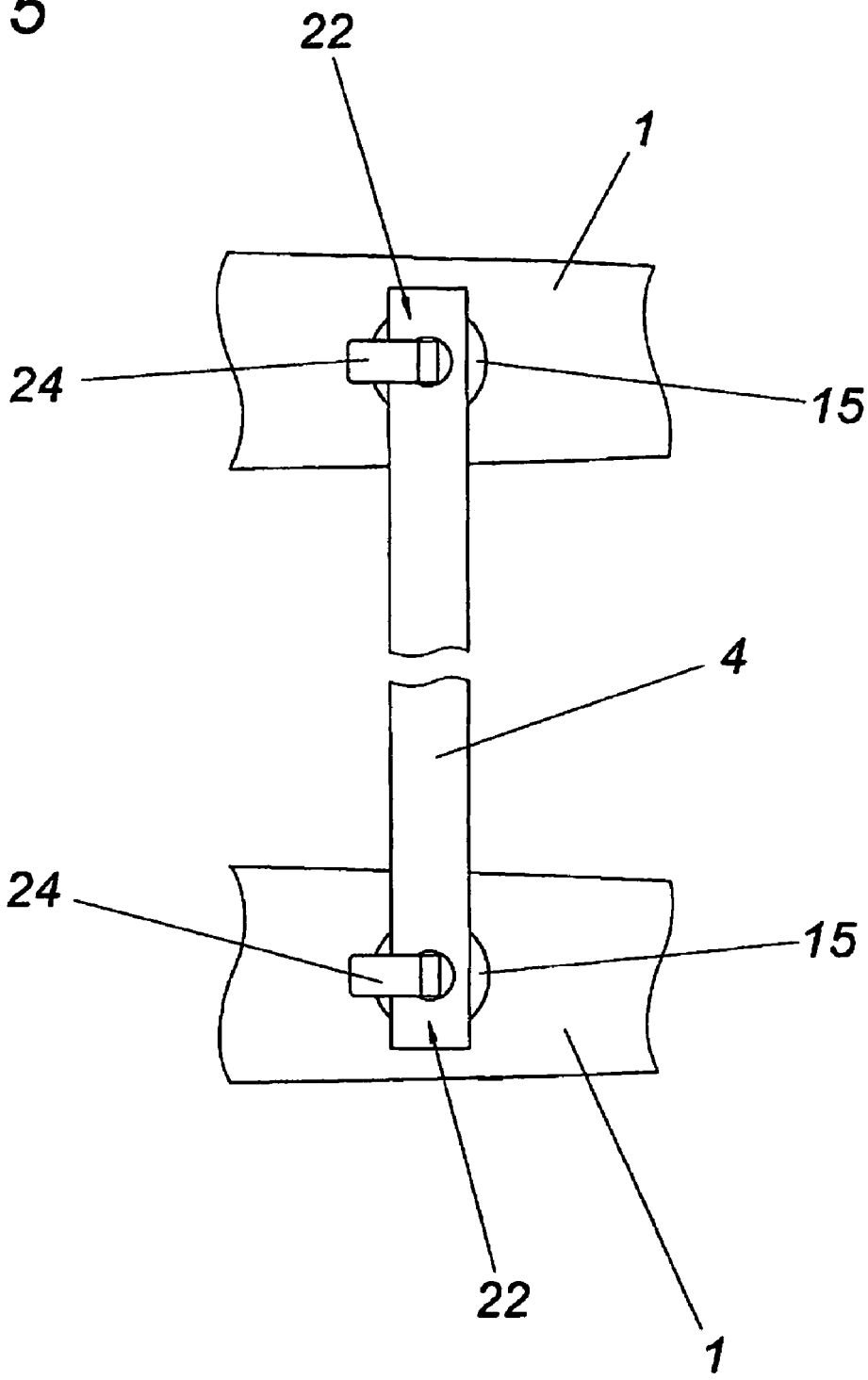
FIG. 5 shows a top view of two hull of a catamaran in section in the area of the connection with the frame.

According to FIGS. 2 and 3, the hulls 1 of a collapsible catamaran are provided with plug-in receptacles 2 for plug-in noses 3 of a frame 4 connecting the two hulls 1 with each other. See FIG. 5. The plug-in receptacles 2 are each formed by a tubular body 5 which penetrates a carrier tube 6 which is embedded in a foam body 7 of the hulls 1. A support tube 8 is used for supporting the tubular body 5, which support tube sits on a sleeve 9 enclosing the carrier tube 6. The tubular body 5 is screwed into a threaded bore 10 of sleeve 9 on the side averted from the support tube 8. The stiffening ribs provided in the area of the support tube 8 and the sleeve 9 are designated with reference numeral 11.

Each of the two hulls 1 is provided with a plastic cover 12 which encloses the foam body 7 and which has a respective recess in the region of the plug-in receptacle 2. In order to achieve a favorable sealing of the plastic cover 12 in the region of the pass-through opening of the plug-in receptacle 2, the support tube 8 forms a bearing flange 13 for the plastic cover 12 which is pressed against the bearing flange 13 with the help of a cap 15 provided with a circumferential annular gasket 14. The fastening of the cap 15 occurs with the help of the tubular body 5 which forms a stop shoulder 16 for the cap 15.

Figure 1:
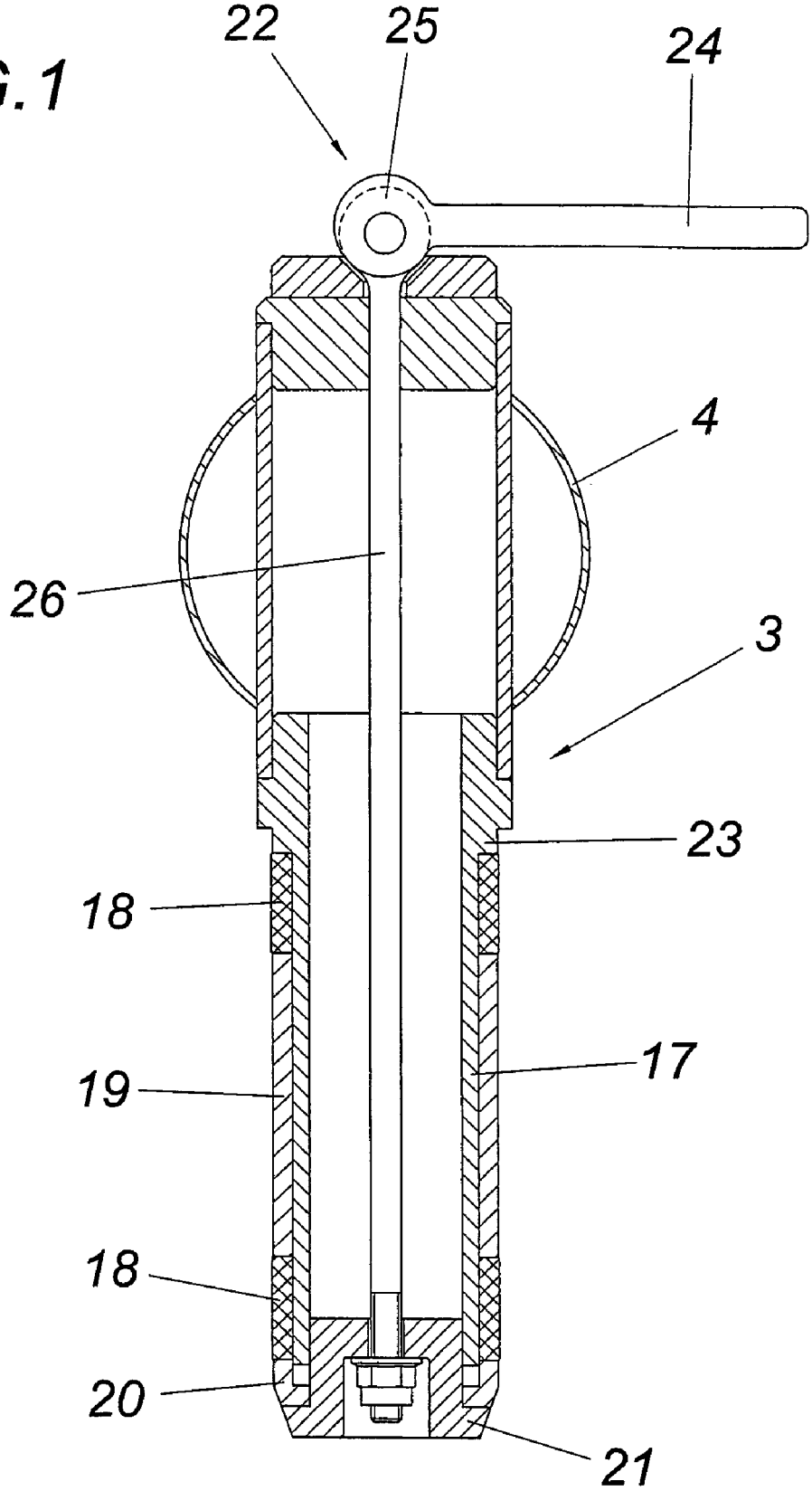
FIG. 1 shows a frame for connecting the hulls of a collapsible catamaran in sections in the area of a plug-in nose in a longitudinal sectional view through the plug-in nose.

In accordance with FIG. 1, the plug-in nose 3 on the frame side comprises a guide tube 17 which carries two rubber-elastic clamping rings 18 which enclose the guide tube 17 on the outside and which are held at a predetermined axial distance from each other by means of an axially displaceable support sleeve 19 which is held on the guide tube 17. While the clamping ring 18 which is arranged in the area of the insertion end of the plug-in nose 3 rests via a pressure ring 20 on an axially guided pressurization head 21 of an actuator 22, the clamping ring 18 which is farther away from the insertion end is supported on an axial abutment 23, which is arranged in the embodiment as a shoulder of the guide tube 17. The actuator 22 is arranged as an eccentric drive according to FIGS. 1 to 3, to whose eccentric 25 which is provided with an actuating lever 24 a drawbar 26 is linked which penetrates the guide tube 17 and acts upon the pressurization head 21. When the eccentric 25 is pivoted from the relaxed initial position according to FIG. 1 with the help of the actuating lever 24 to a tensioned position as shown in FIGS. 2 and 3, the pressurization head 21 is drawn into the guide tube 17 and the clamping ring 18 which is closer to the insertion end of the plug-in nose 3 is axially pressurized via the pressure ring 20, with a part of the pressure being forwarded via the support sleeve 19 to the remoter clamping ring 18 supported on the abutment 23. This means that the clamping ring 18 supported on the pressure ring 20 is squeezed between said pressure ring 20 and the support sleeve 19 and the other clamping ring 18 between the support sleeve 19 and the abutment in an axial manner with the effect that the clamping rings 18 will bulge towards the tubular body 5 of the plug-in receptacle 2 and will tightly clamp the guide tube 17 of the plug-in nose 3 within the tubular body 5 in a play-free manner, as is shown in FIGS. 2 and 3. In order to detach this non-positive water-tight connection, the eccentric drive must be actuated in the opposite direction, so that the elastic restoring forces of the two clamping rings 18 will return the actuating head 21 to the initial position. As a result of the then released movement play between the plug-in nose 3 and the plug-in receptacle 2, the plug-in connection can be released in a simple manner.

Figure 4:
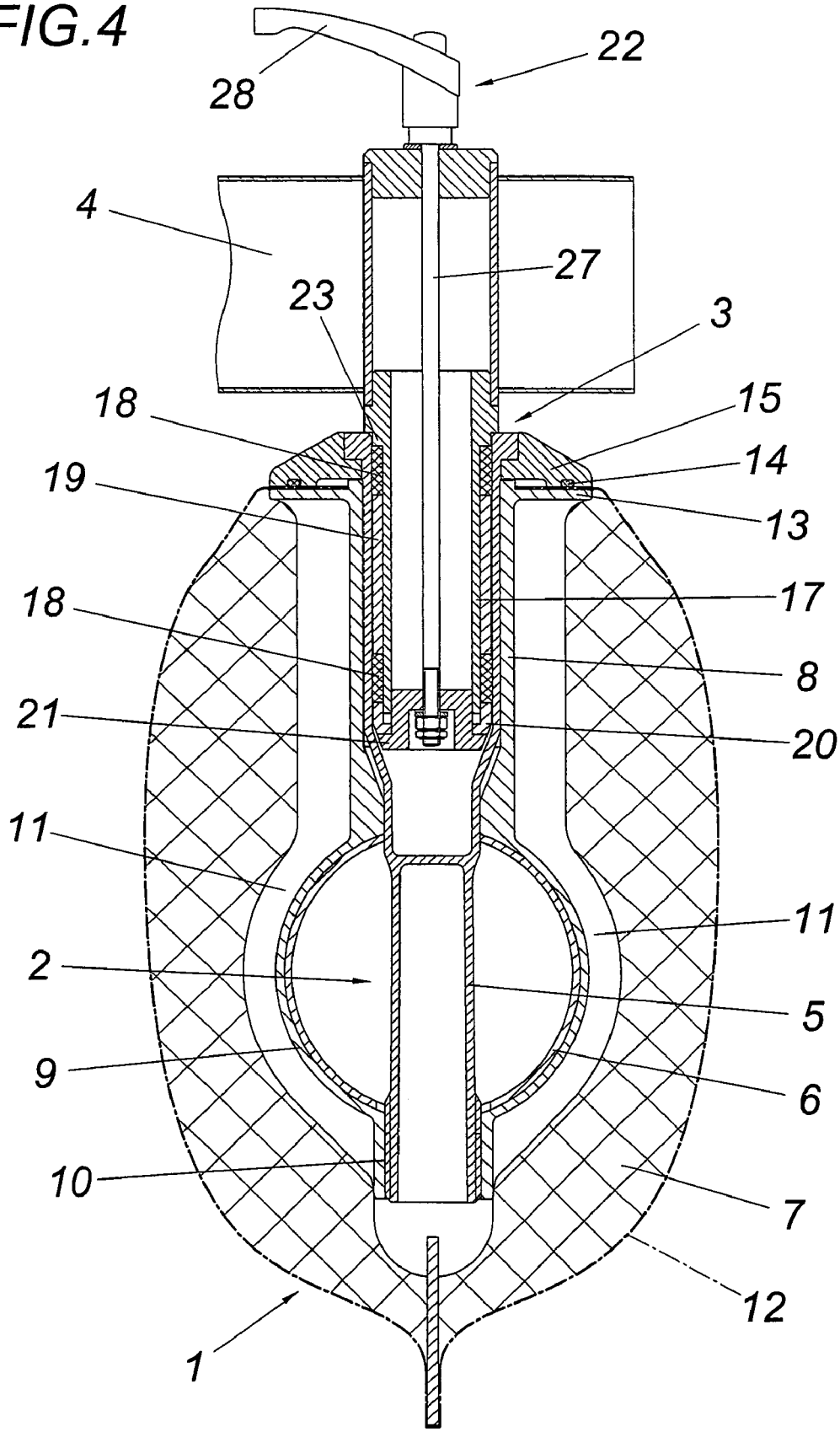
FIG. 4 shows an illustration according to FIG. 2 of a constructional variant of a plug-in connection in accordance with the invention.

The embodiment according to FIG. 4 differs from the one according to FIGS. 1 to 3 merely by the actuator 22 for the axial pressurization of the clamping rings 18. The actuator 22 is arranged as a spindle drive whose spindle 27 penetrating the guide tube acts upon the pressurization head 21. It may remain up to the respective embodiment whether the spindle nut is associated with the actuating handle 28 or the pressurization head 21. In both cases its effective length will decrease in a respective rotation of the spindle 27 in order to enable the pressurization of the clamping rings 18 with the respective pressure. It is especially advantageous in using a spindle drive for clamping pressurization of the clamping rings 18 that higher clamping forces can be achieved without having to apply any excessive manual force. Clamping by means of an eccentric drive provides simpler handling conditions however.

The invention claimed is:

1. A collapsible catamaran comprising:

a first hull comprising a first plug-in receptacle;

a second hull comprising a second plug-in receptacle;

a frame connecting the first hull and the second hull in a detachable manner; and first and second actuators;

wherein the frame comprises a first plug-in nose and a second plug-in nose, wherein the first plug-in nose is inserted into the first plug-in receptacle of the first hull and the second plug-in nose is inserted into the second plug-in receptacle of the second hull;

wherein the first plug-in nose comprises a first guide tube and the second plug-in nose comprises a second guide tube, the first actuator penetrating into the first guide tube and the second actuator penetrating into the second guide tube;

wherein the first guide tube comprises a first longitudinal axis extending in a first axial direction with a first rubber-elastic clamping ring enclosing the first guide tube on an outside portion of the first guide tube;

wherein the first guide tube is supported on a first axial abutment in the first axial direction and is pressed in the first axial direction via the first actuator penetrating the first guide tube;

wherein the second guide tube comprises a second longitudinal axis extending in a second axial direction with a second rubber-elastic clamping ring enclosing the second guide tube on an outside portion of the second guide tube;

wherein the second guide tube is supported on a second axial abutment in the second axial direction and is pressed in the second axial direction via the second actuator penetrating the second guide tube.

2. The collapsible catamaran according to claim 1, wherein the first guide tube of the first plug-in nose further comprises a third clamping ring, and the second guide tube of the second plug-in nose further comprises a fourth clamping ring, wherein the first clamping ring and the third clamping ring are held at an axial distance from each other in the first axial direction by an axially displaceable first support sleeve which is held on the first guide tube, wherein the first clamping ring is supported axially on the first axial abutment and the third clamping ring is squeezed between a first pressure ring and the first support sleeve by the first actuator, wherein the second clamping ring and the fourth clamping ring are held at an axial distance from each other in the second axial direction by an axially displaceable second support sleeve which is held on the second guide tube, wherein the second clamping ring is supported axially on the second axial abutment and the fourth clamping ring is squeezed between a second pressure ring and the second support sleeve by the second actuator.

3. The collapsible catamaran according to claim 1, wherein the first actuator further comprises a first axially guided pressurization head moveable in the first axial direction and protruding from the insertion end of the first guide tube of the first actuator, on which rests a first pressure ring enclosing the insertion end of the first guide tube for squeezing the first clamping ring between the first support sleeve and the first axial abutment, wherein the second actuator further comprises a second axially guided pressurization head moveable in the second axial direction and protruding from the insertion end of the second guide tube of the second actuator, on which rests a second pressure ring enclosing the insertion end of the second guide tube for squeezing the second clamping ring between the second support sleeve and the second axial abutment.

4. The collapsible catamaran according to claim 3, wherein the first actuator further comprises a first eccentric drive comprising a first eccentric connected to a first drawbar which penetrates the first guide tube of the first actuator and moves the first pressurization head in the first axial direction, wherein the second actuator further comprises a second eccentric drive comprising a second eccentric connected to a second drawbar which penetrates the second guide tube of the second actuator and moves the second pressurization head in the second axial direction.

5. The collapsible catamaran according to claim 3, wherein the first actuator further comprises a first spindle drive comprising a first spindle penetrating the first guide tube of the first actuator to move the first pressurization head in the first axial direction, wherein the second actuator further comprises a second spindle drive comprising a second spindle penetrating the second guide tube of the second actuator to move the second pressurization head in the second axial direction.

* * * * *